United States Patent [19]

Fengsheng

[11] Patent Number: 4,966,532

[45] Date of Patent: Oct. 30, 1990

[54] ALL DRY SUBMERSIBLE MOTOR PUMP WITH A CONCORDANT SEAL SYSTEM

[76] Inventor: Lu Fengsheng, 1-50-204, Xian Jiao Tong Univeristy, Xian, Shaanxi, China

[21] Appl. No.: 297,356

[22] Filed: Jan. 17, 1989

[30] Foreign Application Priority Data

Feb. 6, 1988 [CN] China ..... 88100735.8

[51] Int. Cl.[5] ..... F04B 39/00; F04B 47/06

[52] U.S. Cl. ..... 417/366; 417/423.3; 417/423.11; 277/27; 277/34; 277/70; 277/135; 415/111

[58] Field of Search ..... 417/366, 423.3, 423.5, 417/423.9, 423.14, 424.1, 423.11; 277/27, 34, 70, 135; 415/111, 113

[56] References Cited

U.S. PATENT DOCUMENTS

| | | | |
|---|---|---|---|
| 1,879,625 | 9/1932 | Mendenhall et al. | 417/423.3 X |
| 1,941,313 | 12/1933 | Myers | 417/423.3 X |
| 2,002,914 | 5/1935 | Mendenhall et al. | 417/423.11 X |
| 2,363,420 | 11/1944 | Howard | 417/423.3 |
| 2,379,648 | 7/1945 | Myers | 277/135 X |
| 2,404,783 | 7/1946 | Blom | 417/423.11 X |
| 2,736,825 | 2/1956 | Hill | 417/423.14 X |
| 2,962,612 | 11/1960 | Lung | 417/423.3 X |
| 3,250,927 | 5/1966 | Lung | 417/423.3 X |
| 4,015,633 | 4/1977 | Mandell | 417/423.11 X |
| 4,537,385 | 8/1985 | Bragg et al. | 277/27 X |

*Primary Examiner*—Michael Koczo
*Assistant Examiner*—Eugene L. Szezecina
*Attorney, Agent, or Firm*—Pennie & Edmonds

[57] ABSTRACT

The present invention relates to an all-dry submersible motor pump with a concordant seal system. In this submersible pump, there is a motor within a motor room, a vertical rotary shaft driven by the motor and connected to a pump. An air chamber is positioned between the motor room and the water pump. An air-tight disc is provided between the motor room and the air chamber with a central hole for passing through the vertical rotary shaft. A concordant seal is arranged below the disc and around the central hole. The concordant seal comprises a fluid-seal and a pressure equalizer. The pressure equalizer employs a moist-isolating air envelope for equalizing the pressures on both sides of the disc, cooperates with the shaft fluid-seal to prevent the moist air from invading the motor room and thereby ensure a dry working condition for the windings of the motor.

19 Claims, 5 Drawing Sheets

ALL DRY SUBMERSIBLE MOTOR PUMP WITH A CONCORDANT SEAL SYSTEM

BACKGROUND OF THE INVENTION

The invention relates to an all dry submersible motor pump.

The submersible motor pump assembly comprises a motor within a motor room at the upper portion of the assembly, a vertical rotary shaft driven by the motor and connected to a pump means which may be a single or multi-stage pump positioned at the lower portion of the assembly, and an air chamber positioned between the motor room and the pump means.

DESCRIPTION OF THE PRIOR ART

The submersible motor pump is mainly used for pumping water from wells. The known well pumps can be classified into two kinds: the long shaft deep-well-pump and the submersible motor pump which can be subdivided into three types, i.e., the water-immersed type, the shielded type and the oil-immersed type. Among them, the water-immersed one with its motor entirely immersed in water has a low efficiency, a poor reliability in motor and a high rate in maintenance. The shielded one with its winding of motor enveloped by a thin metal case is low in efficiency and difficult to be manufactured. The oil-immersed one immerses the motor in oil with the object to increase the service life of its windings, but the efficiency is even lower, in addition the water tends to enter into the oil chamber thus causing the motor in vain. The long-shaft pump is unwelcomed by the customers because it is complex in structure and has a heavy weight, and moreover it is unconvenient in operation and tends to collapse the wall of a well.

In order to overcome the aforesaid disadvantages, the Japanese Pat. No. JP 58-124094 discloses a "dry submersible motor pump" wherein an air chamber is provided above the pump and under the motor room. When positioning the dry submersible motor pump in a well, the motor pump has to be mounted at a certain moving water level (the water level of a well on pumping water) under the static level in the well (the water level of a well without pumping water), thus the air remained in the motor pump will be compressed under an action of the static pressure of water and the lower the moving level, the greater the inner pressure. The inventor of present application also developed a pump just similar to the said Japanese Patent twenty years ago, however, the experiments showed that when the motor in such a pump is situated over one meter bellow, the water surface it will damage after a period shorter than that in the case of a water-immersed submersible motor pump by the invading of moist air because the "breathing action" of the motor room due to the frequent changes in the temperature of the motor causes the continuous invasion of water vapour from time to time and the failure of seal and thereby the condensed water in the motor room will soon damage the motor.

The Australian Pat. No: W083/00364 also discloses a submersible motor pump for the water-exchange system of a swimming pool, wherein the seal of its rotary shaft employs the oil as sealing medium. This sealing arrangement will totally loss its sealing function when it submerges at a certain depth below the water surface, because the pressures on both sides of the shaft seal are out of balance and the oil medium cannot keep its steady position to prevent the moist air from entering the motor room. Moreover, when the rotary shaft begins to rotate, the oil in the seal cup will leave the center part and press against the side wall of the cup, hence the sealing function in the center of the seal will probably fail.

OBJECTS OF THE INVENTION

An object of the present invention is to provide a safe and reliable submersible motor pump which overcomes the aforesaid disadvantages in the rotary shaft seal for the motor in the pump assembly.

Another object of the present invention is to provide a submersible motor pump in which the windings of the motor can operate in a dry condition without any shielding.

A further object of the present invention is to provide a submersible motor pump which is easier and costs less to be manufactured and the motor of which has a much longer service life.

SUMMARY OF THE INVENTION

In the all-dry submersible motor pump according to this invention, a radial airtight disc is provided between the motor room and the air chamber with a central hole for passing through the vertical rotary shaft and a concordant seal means is arranged below the disc around the central hole, the concordant seal means comprises a shaft fluid-seal means and a pressure equalizing means, the shaft fluid-seal means further comprises a sealing tube and a sealing cup arranged concentrically with the rotary shaft and adapted to rotate relatively, the cup is filled with a certain amount of sealing liquid and the pressure equalizing means comprises an an envelope, the outer surface of which is exposed to the pressure of the air chamber and has an opening through which the air envelope communicates only with the motor room.

The invention will become more fully understood from the detailed description given herein below and the accompanying drawings which are given by way of illustration only and thus are not limitative to the invention.

DETAILED DESCRIPTION OF THE PREFERRED EMBODIMENTS

Figure 1:
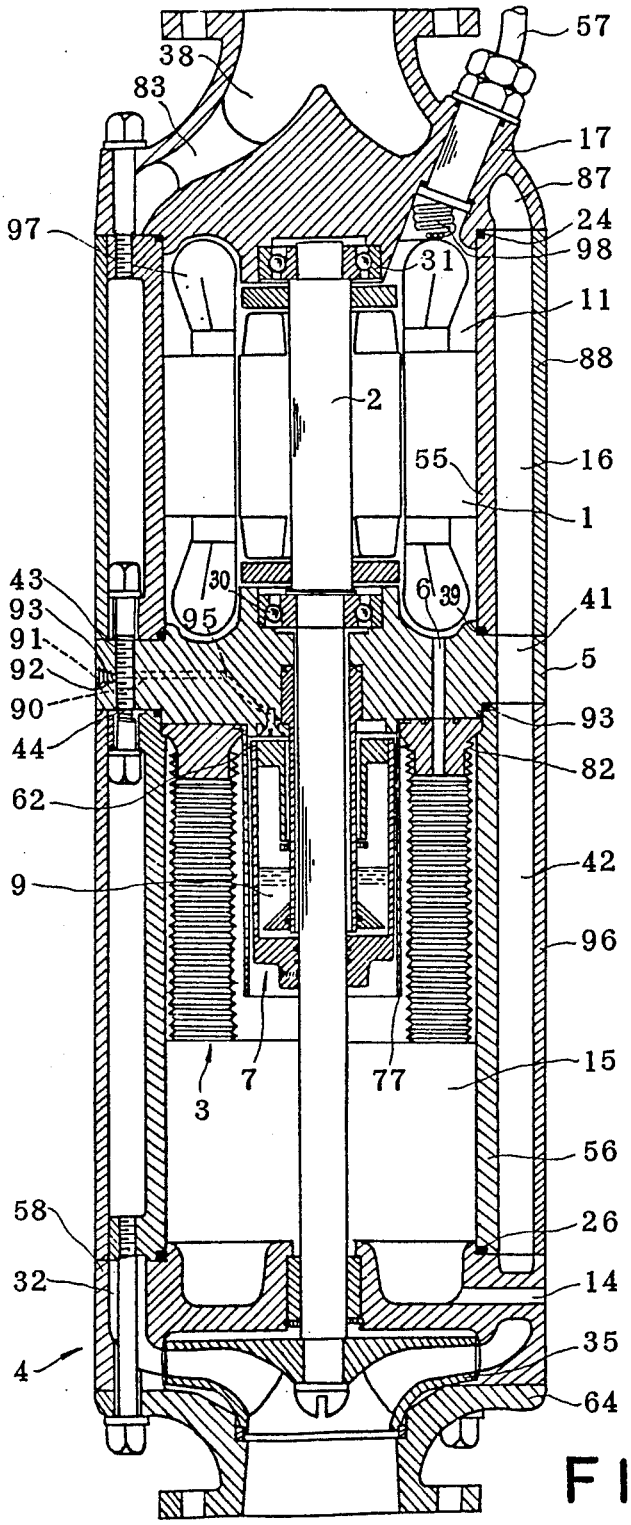
FIG. 1 is a main sectional view of an embodiment for the all-dry submersible motor pump with a concordant seal means according to the present invention.
Figure 2:
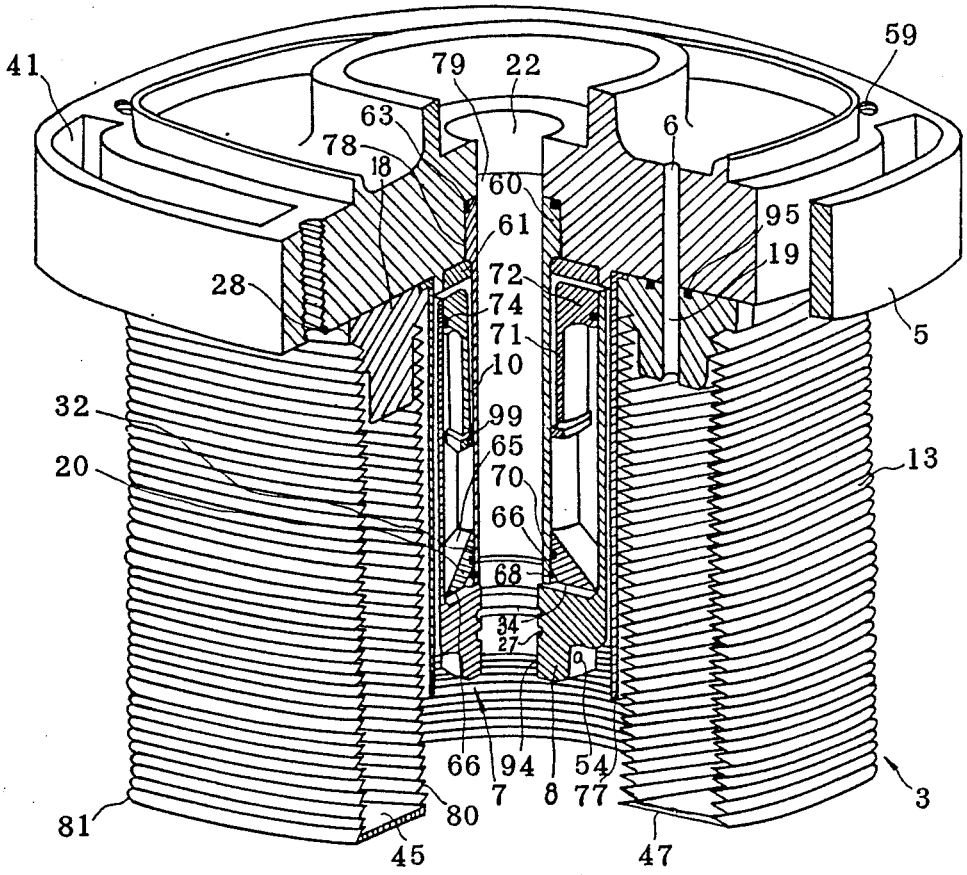
FIG. 2 is a perspective sectional view of an embodiment for the concordant seal means in the all-dry submersible motor pump shown in FIG. 1.

As shown in FIG. 1 and 2, a motor (1) is positioned within a motor room (11). A vertical rotary shaft (2) which is driven by the motor (1) extends downwardly and connected to a water pump means (4). The upper end of the shaft (2) is supported in an upper bearing (31), the middle portion of the shaft is supported in a lower bearing (30).

Motor room (11) is defined by a cylindrical inner shell (55) arranged concentrically with the rotary shaft (2), a pump cover (17) at the top end thereof and a radial airtight disc (5) at the bottom.

The leading-in wire of a cable (57) inside the pump cover (17) should be sealed to prevent the air in the motor room (11) from leakage. Since the sealing between the above mentioned parts pertains to the prior art, it is not necessary to described it herein. However, it has to point out that in order to ensure the seal of the leading-in wire of a cable (57), the lead wire (98) of the three phase cable must be disconnected where it enters in the pump body and connected to the terminals of the winding (97) inside the motor (1) and cast in an insulation medium so as to prevent the air in the motor room (11) from escaping through the cable (57). An outer shell (88) is provided around the inner shell (55) of the motor room (11) and upper annular passage (16) is formed there between. The pump means (4) is arranged at the lower end of the submersible motor pump assembly and comprises an inlet section (64), an outlet section (58) and an impeller (35).

An air chamber (15) is arranged under the motor room (11) and above the pump means (4), which is defined by a cylindrical inner shell (56) arranged concentrically with the rotary shaft (2), the disc (5) at the top and the outlet section (58) of the pump means (4) at the bottom. An outer shell (96) is provided around the inner shell of the air chamber (15) and a lower annular passage (42) is formed (4) there between.

The disc (5) has a diameter equals to the diameter of the outer shell (96) of the air chamber (15) as well as the outer shell (88) of the motor room (11).

There are a plurality of threaded holes spaced near the circumference of the disc (5) used to connect the inner shell (55) of the motor room (11) and the inner shell (56) of the air chamber (15) by means of screws (43) and screws (44) respectively. Near the circumference of openings (41) for passing water through the disc (5) from the lower annular passage (42) to the upper annular passage (16). Each of threaded holes (59) is positioned between two adjacent openings (41). Annular grooves are provided respectively at the ends of the inner shell (56) of the air chamber (15) and the ends of the inner shell (55) of the motor room (11) to receive sealing rings (26), (93), (39) and (24) to establish a hermetic seal Of the air chamber (15) and the motor room (11). The pump cover (17), the motor room (11), the air chamber (15) and the pump means (4) are made integral by means of bolts.

The water is pumped by the pump means (4) from an annular passage (32) of the outlet section (58)of pump means (4) to the outlet (38) at the top of the submersible pump via the lower annular passage (42), the openings (41) in the disc (5), the upper annular passage (16) and annular passage (87) in the pump cover (17). The concordant seal means is provided below the disc (5) to establish a hermetic seal between the motor room (11) and the air chamber (15). The concordant seal means comprises a shaft fluid-seal means (7) and a pressure equalizer (3).

An important feature of the invention is to employ both the pressure equalizer (3) and the shaft fluid-seal means (7) to form a concordant seal system for preventing moist air from invading the motor room (11).

FIG. 2 is a partial sectional view illustrating the structure of the concordant seal means in the all-dry submersible motor pump according to the present invention. The figure shows a cup (8) arranged concentrically with the rotary shaft (2) and a sealing tube (10). A central hole (94) is formed on the bottom of the cup (8) and the inner surface of the hole (94) fits tightly with the outer surface of the rotary shaft (2) so as to rotate the cup (8) synchronistically with the shaft (2). The inner surface of the hole has an annular groove (27) of a square cross section to accommodate an O-ring for establishing a hermatic seal between the cup (8) and rotary shaft (2). A screw (54) is used at the lower portion of the cup (8) for fastening the cup (8) on the rotary shaft (2). The cup is filled with a certain amount of sealing liquid (9), the volume of which amounts to one third of the volume of the cup (8). The sealing liquid is used to isolate the moist air from the motor room (11) and it should be a liquid such as the oil used in transformer or a lubricating oil which has a low evaporability and a low viscosity and non-hydrophilicity, meanwhile its vapour does not influence the insulation of the motor. The upper end of the sealing tube (10) is fixed on the disc (5) and its lower end extends into the sealing liquid (9) in the cup (8) connected with the rotary shaft (2).

As shown in FIG. 2, an enlarged upper portion (60) of the sealing tube (10) is inserted into an enlarged central hole (79) of the disc 95) and the lower surface of the enlarged upper portion (60) is at the same level with the lower surface of disc (5). An annular remaining plate (61) is fixed on the disc (5) by means of screws.

An o-ring (63) is used to keep a hermetic seal between the sealing tube (10) and disc (5). The lower end of the tube (10) is connected with an annular barrier (20) which has a central hole (32)with its inner surface fitting tightly with the outer surface of the tube (10). Both the outer lateral surface (65) and inner lateral surface (66) of the annular barrier (20) are in a conical shape. A semicircular shallow groove formed in the lower end of the tube (10) may accommodate a snap ring (68) of a circular section to prevent the annular barrier (20) from sliding down in the axial direction. An annular groove of a square section is formed in the inner surface of the central hole (32) of the annular, barrier (20), which is used to receive an O-ring (70) to ensure a seal between the annular barrier (20) and tube (10). The outer periphery of the annular barrier (20) is close to the inner wall of the cup (8) and to lower end (34) of the annular barrier (20) is close to the bottom of the cup (8). The inner surface in the top of cup (8) fits tightly with a cup cover (71) which is in the form of a sleeve with a flange (72) at its upper end and has a height corresponding to $\frac{1}{4}$–$\frac{1}{3}$ of the cup's height. There is provided on the outer cylindrical surface of the flange (72) an annular groove with a square-shaped section for receiving an O-ring (74) in order to ensure a seal between the cover (71) and the cup (8) which are fixed together near their tops by means of screws (62). The shape of the cover (71) is such designed that when the cup (8) is placed horizontally or even upside-down, the sealing liquid (9) in the cup (8) will never overflow. In addition, a shield ring (99) is provided in the middle of the sealing tube (10). The shield ring (99) is 3–5 mm high. It's inner surface fits tightly with the outer surface of the sealing tube (10) and an adhesive is used therebetween. The top of the shield ring (99) is at a distance of 2–4 mm from the bottom of the cover (71). The shield ring (99) is used in case the pump assembly is positioned horizontally or even upside-down to protect the sealing liquid (9) from leaking through a gap between the cover (71) and the rotary shaft (2). The cup (8), the tube (10) and the sealing liquid (9) form a shaft seal system (7). When the cup (8) rotates at high speed, the sealing liquid tends to press against the sidewall of the cup (8) because of the centrifugal force and is out of touch with the sealing tube (10), meanwhile the annular barrier (20) which is connected at the lower end of the tube (10) prevents the moist air from penetrating into the inner space of tube (10), thus isolates the air chamber (15) from the motor room (11) completely.

As shown in FIG. 1, there is provided on the periphery of the disc (5) a radial hole (90) which communicates with the inner space of the cup through an oblique hole (95), for charging the cup (8) with sealing liquid (9). One end of the oblique hole intersects with one end of the radial hole (90) and the other end of the oblique hole is open to the inner space of the cup (8). The radial hole (90) has a threaded potion near the periphery of the disc (5). Accordly there is a circle groove for accommodating a gasket (93). A sealing screw (91) is screwed in the threaded portion.

When the pump assembly submerges into water, the pressure in the air chamber (15) increases from an absolute atmosphere to several absolute atmospheres. For example, when the moving water level in the well is 30 meters lower than the static water level, in order to pump water normally, it is necessary to position the pump assembly at the depth of 30 meters under the static water level. During the positioning process, the pressure in the air chamber (15) will increase from one absolute atmosphere to four absolute atmospheres at the depth of 30 meters under the water surface. As the pump assembly submerges gradually in water, it is impossible to prevent moist air in the air chamber (15) with a volume of about three times the volume of the air existed initially in the motor room (11) from entering the motor room (11) solely by means of the sealing liquid (9) without the pressure equalizer (3). The moist air will condense after entering the motor room (11) and damage the motor (1). The novelty of the present invention lies in that the pressure equalizer (3) can be operating concordantly with the sealing liquid (9) to maintain equilibrium between the air pressure in the motor room (11) and that in the air chamber (15).

As shown in FIG. 2, the pressure equalizer (3) mounted in the air chamber (15) employs a foldable bellows-shaped envelope (13) which comprises an inner bellows membrane (80), an outer bellows membrane (81), an annular thin plate (47) and an envelope base (18). The lower ends of both the inner bellows membrane (80) and the outer bellows membrane (81) are bonded by means of an adhesive with the annular thin plate (47) and their upper ends with the base (18), thus to form a closed annular inner cavity (45). Through a stepped flange (28) on the outer of the base (18), the flange (28) of the base (18) is engaged with an annular notch (82) at the upper end of the inner shell (56) of the air chamber (15), so that the base (18) can be held between the disc (5) and the inner shell (56), see FIG. 1. The flat upper surface of the base (18) is engaged with the flat lower surface of the disc (5). A pressure equalizing hole (6) is provided in the disc (5). The envelope base (18) has a through hole (19) having a diameter equal to that of the pressure equalizing hole (6) in the disc (5). The through hole (19) in the base (18) should be aligned with the pressure equalizing hole (6) in the disc (5) in the assembling process to ensure that the annular inner cavity (45) of the envelope (13) communicates only with the inner space of the motor room (11).

There is also provided an O-ring (95) between the disc (5) and the base (18), which includes an annular groove of a square cross section on an upper plane of the base (18) adjacent to the disc (5). The annular groove concentrically surrounds the through hole (19). The O-ring (95) is mounted in the groove to ensure the through hole (19) a hermetic seal from outside.

According to Boylo's law $P_1V_1=P_2V_2$, wherein the $P_1$ is the atmosphere, $P_2$ is the quotient of the depth (measured) in meter) of the moving water level after the motor pump being submerged into water divided by 10 meters, $V_1$ is the sum of the volume in air chamber (16) at 1 atm. and the volume in the residual space of motor room (11), and $V_2$ is the volume of both the air chamber (15) and the motor room (11) under pressure $P_2$.

The residual space in motor room (11) should be filled up with suitable solid materials to ensure that the total residual volume in the inner space of the motor room (11) necessary for keeping the magnetic gap and the ventilation is no greater than 1/n of the sum of the aforesaid residual cavity and the volume of the inner cavity (45) of the envelope (13) in a full condition wherein n is a quotient of the depth (measured in meter) under the static water level divided by 10 meters.

When the pump assembly submerges to a predetermined depth, under the influence of inner pressure in the air chamber (15), the bottom of the air envelope (13) will move upwardly to a place near the disc (5) causing the pressure in the motor room (11) to increase and the envelope (13) stops moving when the pump assembly does not submerge further.

After the motor pump starts to work, the free surface of water in the well falls gradually to the rated moving water level, meanwhile the pressure in the air chamber (15) decreases gradually from the original four absolute atmospheres to about one absolute atmosphere and the pressure in the air chamber (15) under the air envelope (13) decreases at the same time because of a hole (14) in the lower end of the air chamber (15). Since the pressure in the motor room (11) is higher than that in the air chamber (15), the envelope (13) will be stretched out along with the falling of the water level and come back to its initial state.

When the motor pump stops working, the water level in the well will rise again and the pressure in the air chamber (15) will increase gradually. Then the above mentioned process is repeated. The motor room (11) is again filled up with the dry air which has been removed before. During the process of the changes in water level, the fluctuation of the liquid level of the sealing liquid (9) which represents a pressure difference between the motor room (11) and the air chamber (15) is very small because the pressures on both sides of the annular thin plate (47) of the envelope (13) are substantially equilibriums.

Because of the large cross section of the air envelope (13), a little difference of pressures on both sides of the annular thin plate (47) will cause a big force to push the air envelope to change its inner volume. Hence, little fluctuation of the liquid level of the sealing liquid (9) occurs.

Figure 3:
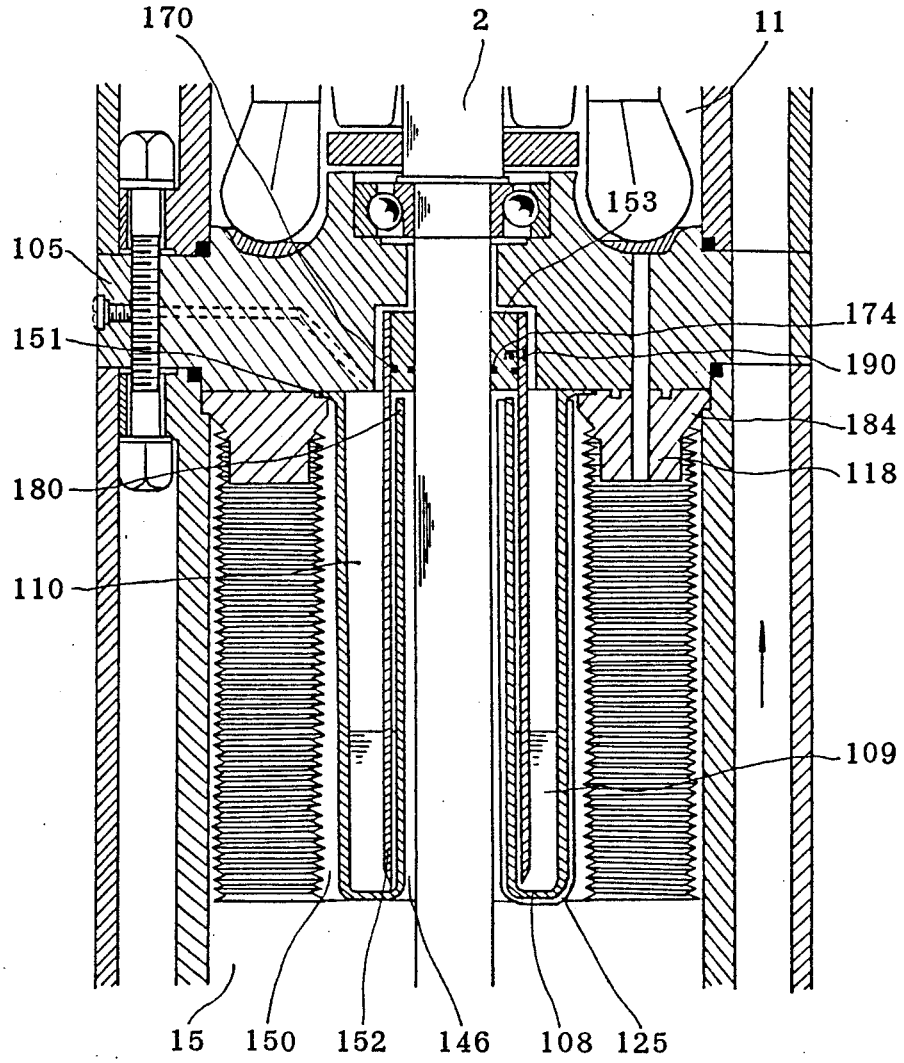
FIG. 3 is a perspective sectional view of another embodiment for the concordant seal means in the all-dry submersible motor pump shown in FIG. 1.

A further embodiment of the concordant seal means according to the present invention is shown in FIG. 3.

The cup (108) which is arranged concentrically with the rotary shaft (2) has an annular trough with a U-shaped cross section, and contains sealing liquid (109). There is an annular notch (151) formed on the inner periphery of the envelope base (118). The cup (108) at its top portion has a flange which is embedded in the notch (151) and clamped between the envelope base (118) and the lower surface of the disc (105).

The sealing tube (110) comprises a cylindrical body (152) and a cover (153) with a central hole in it. There is a seal ring (170) disposed between the cylindrical body (152) and the cover (153) and they are fixed together by means of screws (190). The sealing tube (110) is driven by the rotary shaft (2) since the central hole of the cover (153) fits tightly with it. There is also a seal ring (174) provided between the shaft (2) and the cover (153). The lower end of the sealing tube (110) extends into the sealing liquid (109) contained in the U-shaped trough of the cup (108).

In the exemplary embodiment shown in FIG. 3, the cup (108) is stationary. Therefore it does not cause friction between the cup (108) and water when the cup (108) is submerged. Accordingly, the permissible water level is raised substantially. What is required is only that the water level does not reach the top end of the cup (108). Thus, it is possible to reduce the axial length of the air chamber (15) greatly, lighten the weight of the assembly and reduce the cost in production. However, it may bring about a new problem, i.e., once the water in the air chamber (15) immerses the lower end of the cup (108) during the process of the submergence of the pump, the annular space (150) between the outer periphery of the cup and the inner shell of the air chamber (15) will not communicate with the annular space (146) between the inner periphery of the cup and the rotary shaft (2). When the pump further submerges, because of the volume of the U-shaped air space in the cup (108), the water level in the annular space (146) will rise much faster than the water level in the annular space (150), the water tends to flowover the top end (180) of the cup and destroy the fluid seal. In order to overcome this drawback, the invention provides a U-shaped tube (125) for communicating the annular space (146) and (150). The U-shaped tube, which may be a metal tube or a plastic hose is adhered to the outer surface of the cup (108). An open end of the U-shaped tube (125) extends upwardly to a position near the disc (105) in the annular space (150) while the other end of the U-shaped tube (125) extends upwardly to a position near the top end (180) of the cup (108) in the annular space (146).

The membrane of the bellows in the above two embodiments may be made of a polymer film coated at the dry side with a thin layer of metal, such as aluminum. The polymer film may be of a variety of materials with a very low permeability such as polyvinylidene chloride (PVDC).

Figure 4:
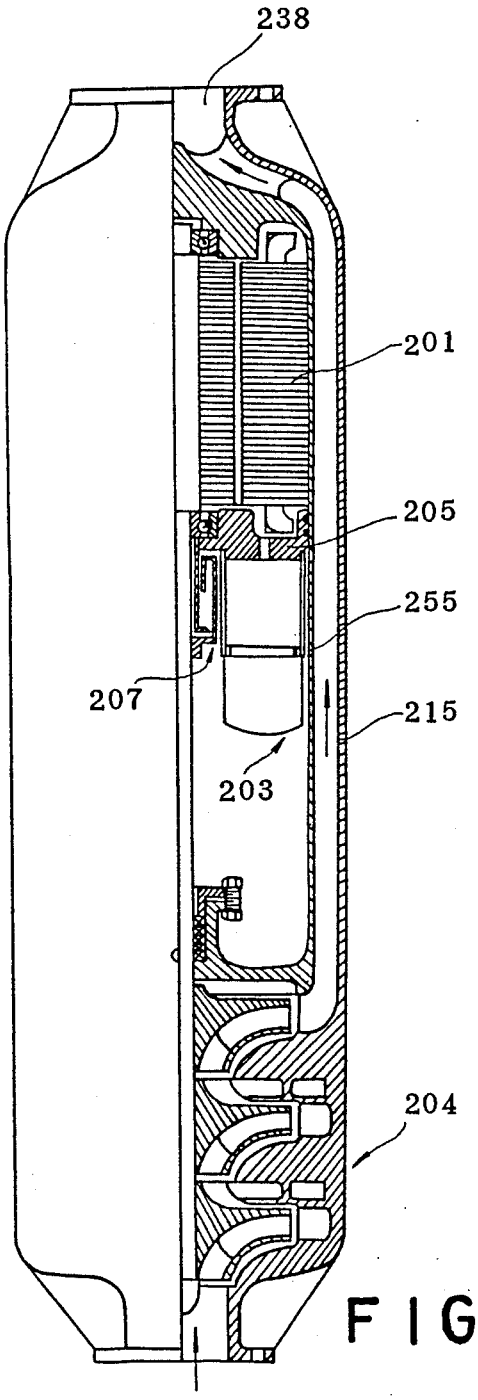
FIG. 4 is a schematic diagram of another embodiment of the all-dry submersible motor pump with the concordant seal means employing a pocket-shaped envelope.

FIG. 4 is a schematic view of another embodiment of the all-dry submersible pump in which a shaft fluid-seal means (207) and a pressure equalizer (203) are employed in the concordant seal means. The fluid seal means (207) as shown in FIG. 4 is the same as that illustrated in FIG. 2, whereas the pressure equalizer (203) is of a pocket-shaped envelope construction.

The water is pumped by the pump means (204) to the outlet of the pump (238) through an annular passage between an inner shell (255) and an outer shell (215) in a direction as indicated by the arrow. The disc (205) is fixed to the inner shell (255).

Figure 5:
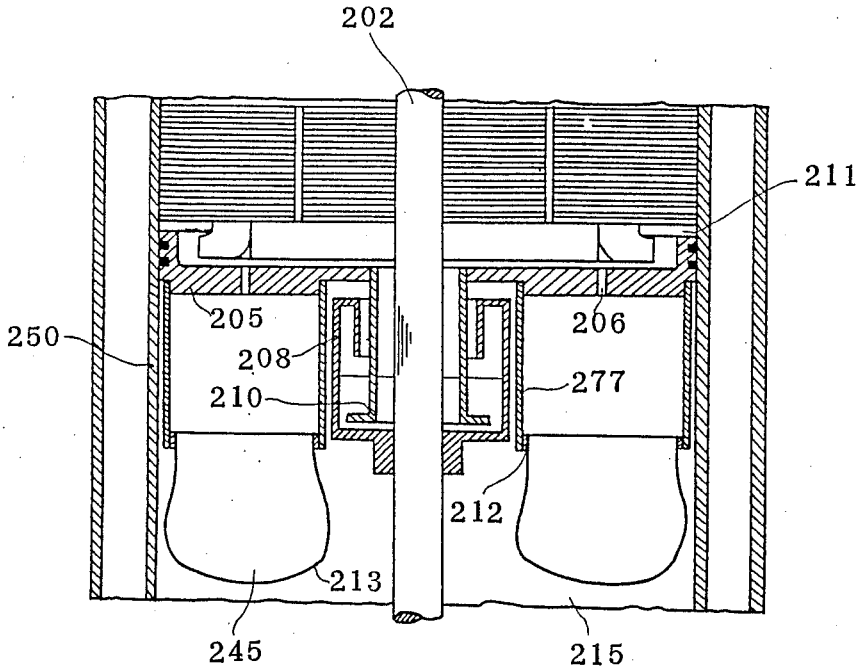
FIG. 5 is a enlarged schematic view of the concordant seal means in the all-dry submersible motor pump shown in FIG. 4.

FIG. 5 is an enlarged schematic view of the concordant seal means in FIG. 4. In this embodiment according to the invention, eight pressure equalizers are spaced evenly around the rotary shaft (202). Each of the pressure equalizer comprises an air envelope (213), a protective sleeve (277) and a clamping ring (212). The air envelope (213) is of a pocket-shaped construction and made of a hermetic flexible material such as rubber or a polymer film whose infiltration capacity of water vapor per 1000 hours being less than 0.1 gram. In this embodiment the air envelope (213) is made of rubber.

The pocket-shaped air envelope (213) is mounted on the disc (205) by the protective sleeve (277) and the clamping ring (212). The open end of the air envelope (213) is bonded with a sealant between the clamping ring (212) and the lower end of the protective sleeve (277), the upper end of the protective sleeve (277) is fixed to the disc (205). There are eight pressure equalizing holes (206) spaced evenly on the disc (205) which is positioned between the motor room (211) and the air chamber (215). The protective rings (277) are mounted on the disc (205) around the pressure equalizing holes (206) respectively such that an inner cavity (245) of the air envelopes (215) communicate only with the motor room (211).

The protective sleeve (277) prevents the pocket-shaped envelope (213) from directly contacting with the rotating cup (208). The pocket-shaped envelope may have many modifications, e.g. it may be made circular with an annular inner cavity. Accordingly, only two protective sleeves are needed, an outer sleeve and an inner sleeve. The open end of the circular envelope is connected to the outer and inner protective sleeves via two clamping rings using the same method as described in the above embodiment.

It is due to the cooperation of the pressure equalizing means and the shaft fluid-seal means of the concordant seal means that ensures the normal operation of the motor pump.

The aforesaid submersible motor pump with a pressure equalizing shaft seal in air envelope type can prevent completely the moist air from entering into the motor room, thus ensuring the motor to operate in an all-dry condition. This motor pump reduces the requirements both in the quality of the materials and the technology for the manufacture of the motor, prolongs the service life of the motor, and makes the motor reliable in working. In addition, the submersible motor pump has the following distinguishable advantages:

1. Saving materials and reducing cost for it does not need a long shaft or a water-proofed enamel wire of high insulation;

2. Reducing energy consumption, for it avoids the energy consumption caused by a long shaft and prevents a decreasing in motor efficiency caused by a motor immersed in a liquid;

3. Convenience in assembling disassembling for it does not need a complicated assembling and adjusting of a long shaft;

4. High suitability for the pump with a long shaft can not be employed in a well of a larger curvature and the wet type submersible motor pump is unsuitable for a deep well with a high sand-carrying capacity while the present pump assembly is able to operate either in a will with a larger curving axis or in a well with a high said-carrying capacity without special wear means.

5. Simple in construction and in fabricating technology;

6. Appropriateness in use. A pump set with a long shaft can not be employed serially and a motor in the existing wet-type submersible motor pumps is mounted on the bottom to admit the water to come in from the sides all around the pumps in its middle portion so that they cannot be used serially. The utilization in a serial form is the most reasonable and scientific way in pumping water from a deep well which can substantially reduce the cost and prolong the service life. The pump according to the present invention is particularly designed to be utilized in a serial form;

7. Reasonable design. Since the water flows through the inner shell of the motor, the cooling condition of the motor tends to be more suitable.

The all-day submersible motor pump according to the present invention if generalized may save a large amount of electrical energy, many labours and materials which are spent for repairing traditional submersible motor pumps. Moreover, it can be used to replace the existing deep well pumps of other types.

I claim:

1. An all-dry submersible motor pump comprising a motor within a motor room, a vertical rotary shaft driven by the motor and connected to a pump means, an air chamber positioned between the motor room and the pump means, a radial airtight disc provided between the motor room and the air chamber with a central hole for passing through the vertical rotary shaft, and a concordant seal means arranged below the disc and around the central hole, wherein said concordant seal means comprises a shaft fluid-seal means and a pressure equalizing means, said shaft fluid-seal means further comprising a sealing tube and a sealing cup arranged concentrically with the rotary shaft and adapted to rotate relatively, said cup being filled with a certain amount of sealing liquid, and said pressure equalizing means comprising an air envelope, the outer surface of which being exposed to the pressure of the air chamber and having an opening through which the air envelope communicates only with the motor room.

2. A submersible motor pump according to claim 1, wherein at least one pressure equalizing hole is provided in the disc.

3. A submersible motor pump according to claim 1, wherein the air envelope is of a foldable bellows-shaped construction.

4. A submersible motor pump according to claim 3, wherein the foldable bellows-shaped air envelope comprises an inner bellows membrane, an outer bellows membrane, an annular thin plate and an envelope base, the lower ends of both the inner bellows membrane and the outer bellows membrane being bonded by means of an adhesive to the annular thin plate and their upper ends with the base, thus to form a closed annular inner cavity, and the envelope base being provided with a through hole having a diameter equal to that of the pressure equalizing hole.

5. A submersible motor pump according to claim 4, wherein the upper surface of the base is engaged with the flat lower surface of the disc, the through hole in the base is aligned with the pressure equalizing hole in the disc in the assembling process, an annular groove of a square cross section is provided on the an upper surface of the base adjacent to the disc, and the annular groove concentrically surrounds the through hole to accommodate an O-ring.

6. A submersible motor pump according to claim 1; wherein the air envelope is of a pocket-shaped construction.

7. A submersible motor pump according to claim 6, wherein the pocket-shaped air envelope is mounted on the disc by a protective sleeve and a clamping ring, the open end of the air envelope is bonded with a sealant between the clamping ring and the lower end of the protective sleeve, the upper end of the protective sleeve is fixed to the disc.

8. A submersible motor pump according to claim 1, wherein the air envelope is made of a hermetic flexible material.

9. A submersible motor pump according to claim 8, wherein the air envelope is made of a polymer film coated with a thin layer of metal.

10. A submersible motor pump according to claim 8, wherein the air envelope is made of rubber.

11. A submersible motor pump according to claim 8, wherein the air envelope is made of polyvinylidene chloride.

12. A submersible motor pump according to claim 1, wherein a central hole is formed on the bottom of the cup, the inner surface of the hole fits tightly with the outer surface of the rotary shaft so as to rotate the cup with the shaft, the upper end of the sealing tube is fixed to the disc, the lower end of the sealing tube extends into the sealing liquid contained in the cup, the lower end of the sealing tube is connected with a annular barrier, the outer periphery of the annular barrier is close to the inner wall of the cup and the lower end of the annular barrier is close to the bottom of the cup, a semicircular shallow groove is formed in the lower end of the sealing tube for accommodating a snap ring.

13. A submersible motor pump according to claim 12, wherein the annular barrier has a central hole with its inner surface fitting tightly with the outer surface of the sealing tube, an inner and outer conical surfaces and an annular groove of a square cross section is formed in the inner surface of the central hole for accommodating an O-ring.

14. A submersible motor pump according to claim 12, wherein the top end of the cup is connected to a cover by means of screws, the cover is in the form of a sleeve with a flange at its upper end and has a height corresponding to $\frac{1}{4}$–$\frac{1}{3}$ of the cup's height, the inner surface in the top of the cup fits tightly with the outer periphery of the flange, a plurality of threaded holes are provided on the outer periphery of the flange near its upper end for screwing in the screws, and an annular groove of a square cross section is provided below the threaded holes for receiving an O-ring in order to ensure a seal between the cover and the cup.

15. A submersible motor pump according to claim 12, wherein a shield ring is provided in the middle of the sealing tube, an inner surface of the shield ring fits tightly with the outer surface of the sealing tube, and an adhesive is used there between.

16. A submersible motor pump according to claim 1 or 4, wherein the sealing cup has an annular trough with a U-shaped cross section, the cup at its top portion has a flange which is embedded in a circular notch formed on an inner periphery of the envelope base and clamped between the envelope base and the lower end of the disc, the sealing tube has a cylindrical body and a cover with a central hole, the inner surface of the hole fits tightly with the outer surface of the rotary shaft so as to rotate the tube with the shaft, the lower end of the sealing tube extends into the sealing liquid contained in the cup.

17. A submersible motor pump according to claim 15, wherein a U-shaped tube is fixed to the outer surface of the cup, an open end of the U-shaped tube extending upwardly to a place near the disc in an annular space formed between the outer periphery of the cup and the inner shell of the air chamber, and the other end of the U-shaped tube extending upwardly to a place near the top end of the cup in an annular space formed between the inner periphery of the cup and the rotary shaft.

18. A submersible motor pump according to claim 1, wherein the sealing liquid has a low evaporability and nonhydrophilicity.

19. A submersible motor pump according to claim 1, wherein a radial hole is provided on the periphery of the disc, the hole communicates with the inner space of the cup through an oblique hole, for charging the cup with the sealing liquid, one end of the oblique hole intersects with one end of the radial hole and the other end of the oblique hole is open to inner space of the cup.

* * * * *